US006371860B1

(12) United States Patent
Anderson

(10) Patent No.: US 6,371,860 B1
(45) Date of Patent: Apr. 16, 2002

(54) FOUL LINE INDICATOR FOR POOL TABLES

(76) Inventor: Douglas Anderson, 1197 Highway 36 East, Carrollton, KY (US) 41008

( * ) Notice: Subject to any disclaimer, the term of this patent is extended or adjusted under 35 U.S.C. 154(b) by 0 days.

(21) Appl. No.: 09/502,303

(22) Filed: Feb. 11, 2000

(51) Int. Cl.[7] ..... A63D 15/00
(52) U.S. Cl. ..... 473/1; 473/2; 473/31
(58) Field of Search ..... 473/1, 2, 46, 465, 473/467, 150, 151; 273/445, 454; 33/286, 289; 340/556, 541, 557; 434/21

(56) References Cited

U.S. PATENT DOCUMENTS

| | | | | | |
|---|---|---|---|---|---|
| 2,380,756 | A | | 7/1945 | Henry | |
| 3,741,662 | A | * | 6/1973 | Pioch | 356/399 |
| 3,825,916 | A | * | 7/1974 | Steele et al. | 340/557 |
| 4,130,281 | A | * | 12/1978 | Leber et al. | 273/336 |
| 4,422,647 | A | * | 12/1983 | Wilson et al. | 473/467 |
| 4,531,732 | A | | 7/1985 | Harris | |
| 4,882,676 | A | | 11/1989 | Van De Kop et al. | |
| 5,165,691 | A | * | 11/1992 | Cook | 473/220 |
| 5,275,398 | A | | 1/1994 | Compton | |
| 5,338,262 | A | | 8/1994 | Hayes | |
| 5,738,595 | A | | 4/1998 | Carney | |
| 6,070,992 | A | * | 6/2000 | Schnell | 362/259 |

* cited by examiner

*Primary Examiner*—Paul T. Sewell
*Assistant Examiner*—Mitra Aryanpour

(57) ABSTRACT

A foul line indicator for pool tables for identifying the foul line behind which a player is allowed to shoot a cue ball. The foul line indicator for pool tables includes a laser light mechanism which includes housing and a conventional laser light disposed therein. The laser light mechanism is disposed under a side rail and in a side wall under the second diamond displayed on top of the side rail and located from either end of the pool table. The laser light is adapted to direct a light beam across the playing surface of the pool table from one side to the other side to indicate the foul line. The laser light is energized by a switch disposed in the side wall of the pool table and which is connected to the laser light mechanism with wires, and also by a power source.

7 Claims, 1 Drawing Sheet

FOUL LINE INDICATOR FOR POOL TABLES

BACKGROUND OF THE INVENTION

1. Field of the Invention

The present invention relates to a foul line identified by a laser light and more particularly pertains to a new foul line indicator for pool tables for identifying the foul line behind which a player is allowed to shoot a cue ball.

2. Description of the Prior Art

The use of a foul line identified by a laser light is known in the prior art. More specifically, foul line identified by a laser light heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,380,756; U.S. Pat. No. 5,738,595; U.S. Pat. No. 5,338,262; U.S. Pat. No. 5,275,398; U.S. Pat. No. 4,882,676; and U.S. Pat. No. 4,531,732.

While these devices fulfill their respective, particular objectives and requirements, the aforementioned patents do not disclose a new foul line indicator for pool tables. The inventive device includes a laser light mechanism which includes housing and a conventional laser light disposed therein. The laser light mechanism is disposed under a side rail and in a side wall under the second diamond displayed on top of the side rail and located from either end of the pool table. The laser light is adapted to direct a light beam across the playing surface of the pool table from one side to the other side to indicate the foul line. The laser light is energized by a switch disposed in the side wall of the pool table and which is connected to the laser light mechanism with wires, and also by a power source.

In these respects, the foul line indicator for pool tables according to the present invention substantially departs from the conventional concepts and designs of the prior art, and in so doing provides an apparatus primarily developed for the purpose of identifying the foul line behind which a player is allowed to shoot a cue ball.

SUMMARY OF THE INVENTION

In view of the foregoing disadvantages inherent in the known types of foul line identified by a laser light now present in the prior art, the present invention provides a new foul line indicator for pool tables construction wherein the same can be utilized for identifying the foul line behind which a player is allowed to shoot a cue ball.

The general purpose of the present invention, which will be described subsequently in greater detail, is to provide a new foul line indicator for pool tables which has many of the advantages of the foul line identified by a laser light mentioned heretofore and many novel features that result in a new foul line indicator for pool tables which is not anticipated, rendered obvious, suggested, or even implied by any of the prior art foul line identified by a laser light, either alone or in any combination thereof.

To attain this, the present invention generally comprises a laser light mechanism which includes housing and a conventional laser light disposed therein. The laser light mechanism is disposed under a side rail and in a side wall under the second diamond displayed on top of the side rail and located from either end of the pool table. The laser light is adapted to direct a light beam across the playing surface of the pool table from one side to the other side to indicate the foul line. The laser light is energized by a switch disposed in the side wall of the pool table and which is connected to the laser light mechanism with wires, and also by a power source.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new foul line indicator for pool tables which has many of the advantages of the foul line identified by a laser light mentioned heretofore and many novel features that result in a new foul line indicator for pool tables which is not anticipated, rendered obvious, suggested, or even implied by any of the prior art a foul line identified by a laser light, either alone or in any combination thereof.

It is another object of the present invention to provide a new foul line indicator for pool tables which may be easily and efficiently manufactured and marketed.

It is a further object of the present invention to provide a new foul line indicator for pool tables which is of a durable and reliable construction.

An even further object of the present invention is to provide a new foul line indicator for pool tables which is susceptible of a low cost of manufacture with regard to both materials and labor, and which accordingly is then susceptible of low prices of sale to the consuming public, thereby making such foul line indicator for pool tables economically available to the buying public.

Still yet another object of the present invention is to provide a new foul line indicator for pool tables which provides in the apparatuses and methods of the prior art some of the advantages thereof, while simultaneously overcoming some of the disadvantages normally associated therewith.

Still another object of the present invention is to provide a new foul line indicator for pool tables for identifying the foul line behind which a player is allowed to shoot a cue ball.

Yet another object of the present invention is to provide a new foul line indicator for pool tables which includes a laser light mechanism which includes housing and a conventional laser light disposed therein. The laser light mechanism is disposed under a side rail and in a side wall under the second diamond displayed on top of the side rail and located from either end of the pool table. The laser light is adapted to direct a light beam across the playing surface of the pool table from one side to the other side to indicate the foul line. The laser light is energized by a switch disposed in the side wall of the pool table and which is connected to the laser light mechanism with wires, and also by a power source.

Still yet another object of the present invention is to provide a new foul line indicator for pool tables that allows the players to quickly identify whether the next placeable cue shot is being made behind the foul line.

Even still another object of the present invention is to provide a new foul line indicator for pool tables that eliminates the need of having to use a string to identify the foul line.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
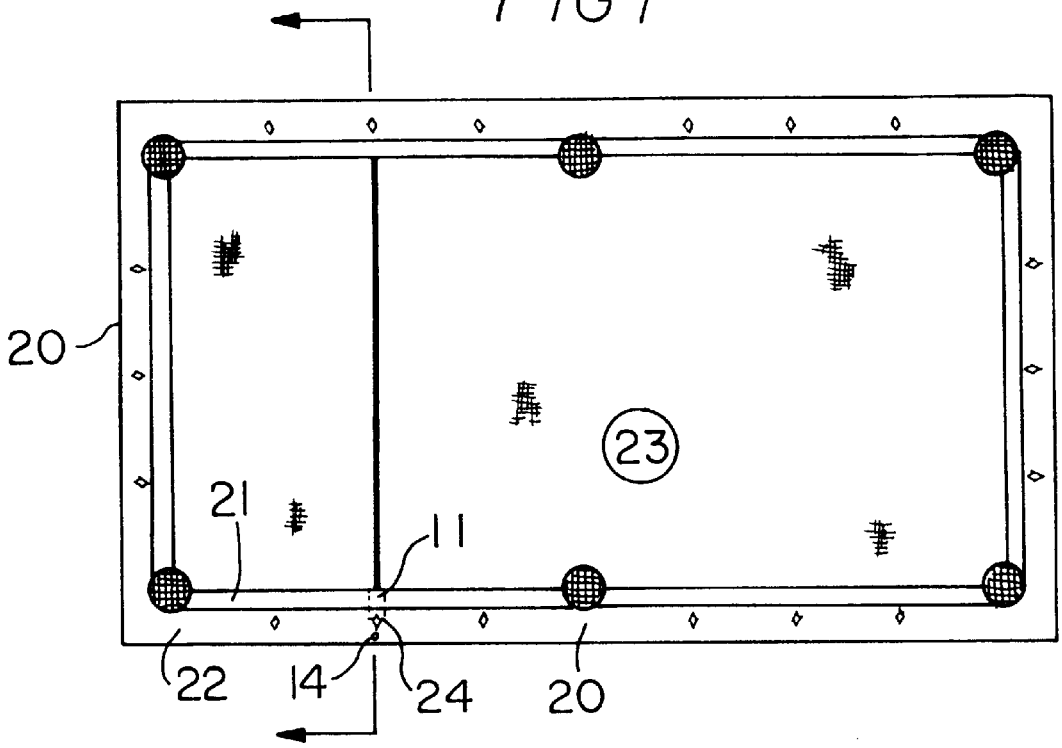
FIG. 1 is a top plan view of a new foul line indicator for pool tables according to the present invention.
Figure 2:
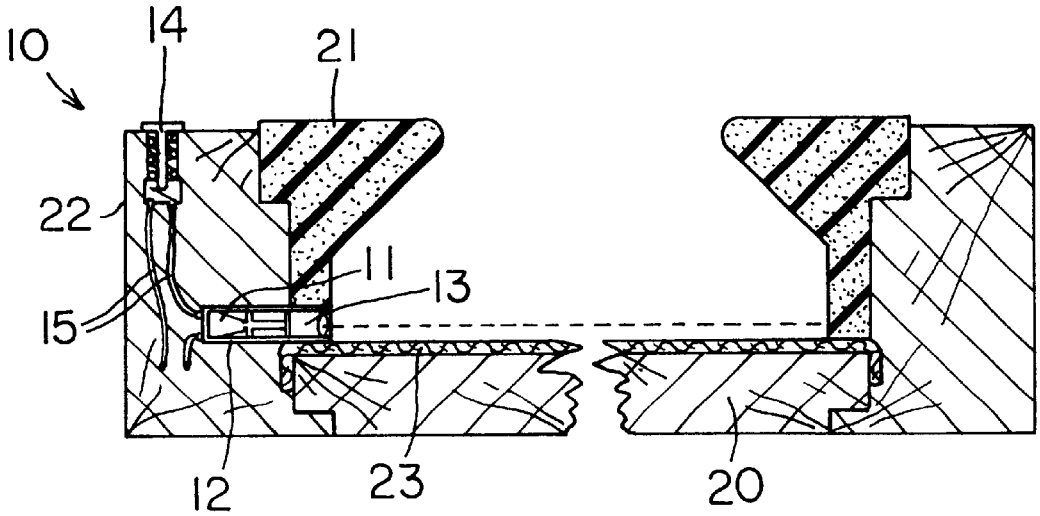
FIG. 2 is a side cross-sectional view of the present invention.

With reference now to the drawings, and in particular to FIGS. 1 through 2 thereof, a new foul line indicator for pool tables embodying the principles and concepts of the present invention and generally designated by the reference numeral 10 will be described.

As best illustrated in FIGS. 1 through 2, the foul line indicator for pool tables 10 generally comprises a laser light mechanism 11 adapted to be disposed under a side rail 21 and above a playing surface 23 of a pool table 20 and adapted to direct a beam of light across a pool table 20 to indicate a foul line. The laser light mechanism 11 includes a housing 12 and a conventional laser light 13 disposed in the housing 12 and facing across the playing surface 23 of the pool table 20. The laser light mechanism 11 is disposed under a side rail 21 and in a side wall 22 of the pool table 20 and is disposed near either end of the pool table 20. The laser light mechanism 11 is vertically aligned with a second diamond 24 located from either end of the pool table 20 and being displayed on a top of the side wall 22.

A means to energize the laser light mechanism 11 includes a switch 14 mounted to the pool table 20 and connected to the laser light mechanism 11 with wires 15, and further includes a power source (not shown) which is connected to the switch 14 with wires 15. The switch 14 is an on/off switch and is imbedded in a portion of the pool table 20.

In use, the user would switch on the power to the laser light mechanism 11 which causes a light beam to be directed across the playing surface 23 of the pool table 20 to identify the foul line at either end of the pool table 20. If one player scratches on a cue shot, the other player is allowed to place the cue ball at one designated end of the pool table 20 and no farther from the end of the pool table 20 than that designated by the beam of light and such player is allowed to line up one's next shot.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. In combination:

a pool table having a playing surface and a side rail extending adjacent to said playing surface; and a foul line indicator comprising:

a laser light mechanism adapted to be disposed under a rail and above a playing surface of a pool table and adapted to shoot a beam of light across a pool table to indicate a foul line, said laser light mechanism including a housing, a laser light disposed in said housing and facing across the playing surface of the pool table; and a means to energize said laser light mechanism;

wherein said laser light mechanism is disposed under a side rail of the pool table and is disposed near an end of the pool table, said laser light mechanism shining a beam of light across said playing surface along a foul line thereof when said laser light mechanism is energized for reflecting light off of any pool balls lying along said foul line.

2. A foul line indicator for pool tables as described in claim 1, wherein said laser light mechanism is substantially vertically aligned with a diamond located from either end of the pool table and displayed on a top of the side wall.

3. A foul line indicator for pool tables as described in claim 1, wherein said means for energizing said laser light mechanism includes a switch mounted to said pool table and electrically connected to said laser light mechanism, and further includes a power source which is electrically connected to said switch.

4. A foul line indicator for pool tables as described in claim 3, wherein said switch is an on/off switch and said switch is imbedded in a portion of the pool table.

5. In combination:

a pool table having a playing surface and a side rail extending adjacent to said playing surface, a side wall extending adjacent to said playing surface below said side rail, said side wall having a substantially vertical side wall surface, said side rail having a cantilever surface extending outwardly over a portion of said playing surface; and a foul line indicator comprising:

a laser light mechanism mounted on said pool table and being disposed on the side wall surface of said side wall above said playing surface said laser light mechanism directing a beam of light across the playing surface of said pool table to indicate a foul line, said laser light mechanism including a housing, a laser light disposed in said housing and facing across the playing surface of said pool table, said laser light mechanism being vertically aligned with a diamond indicia located toward an end of said pool table and displayed on a top surface above said side rail; and a means to energize said laser light mechanism including a switch mounted to the pool table and electrically connected to said laser light mechanism, and further including a power source electrically connected to said switch, said switch being an on/off switch and being imbedded in a portion of the pool table.

6. A method of indicating a foul line on a pool table comprises the steps of:

providing a pool table having a playing surface and a side rail extending adjacent to said playing surface and a laser light mechanism having a housing and a laser light disposed inside said housing, said housing being disposed under said side rail and in a side wall of said pool table and in substantial vertical alignment with a diamond marking located above the side rail of said pool table, and further providing a means to energize said laser light; and shining a beam or light across the playing surface of said pool table to mark the foul line on the playing surface of the pool table from one side to the other side by reflecting said beam of light on any pool balls lying oil said playing surface along the foul line.

7. The method of claim 6 additionally comprising the step of playing a game of pool on said playing surface while said beams of light is shown across said playing surface along said foul line.

* * * * *